US007640683B2

(12) United States Patent
McCain

(10) Patent No.: US 7,640,683 B2
(45) Date of Patent: Jan. 5, 2010

(54) METHOD AND APPARATUS FOR SATELLITE POSITIONING OF EARTH-MOVING EQUIPMENT

(75) Inventor: Steven Daniel McCain, San Joaquin County, CA (US)

(73) Assignee: Topcon Positioning Systems, Inc., Livermore, CA (US)

( * ) Notice: Subject to any disclaimer, the term of this patent is extended or adjusted under 35 U.S.C. 154(b) by 509 days.

(21) Appl. No.: 11/108,013

(22) Filed: Apr. 15, 2005

(65) Prior Publication Data

US 2006/0230645 A1 Oct. 19, 2006

(51) Int. Cl.
*E02F 5/02* (2006.01)
*G06G 7/00* (2006.01)

(52) U.S. Cl. ..... 37/348; 37/382; 701/50; 414/699

(58) Field of Classification Search ..... 37/348, 37/382, 414, 416; 701/50; 172/2, 5, 811; 414/699, 718
See application file for complete search history.

(56) References Cited

U.S. PATENT DOCUMENTS 4,829,418 A 5/1989 Nielsen et al.
4,888,890 A 12/1989 Studebaker et al.
5,019,761 A 5/1991 Kraft
5,100,229 A 3/1992 Lundberg et al.
5,546,093 A * 8/1996 Gudat et al. ..... 701/214
5,551,524 A 9/1996 Yamamoto et al.
5,604,715 A * 2/1997 Aman et al. ..... 367/118
5,612,864 A * 3/1997 Henderson ..... 700/59
5,646,844 A * 7/1997 Gudat et al. ..... 701/208
5,649,600 A * 7/1997 Marsh ..... 172/4.5
5,666,792 A 9/1997 Mullins
5,711,022 A * 1/1998 Steenwyk ..... 701/50
5,764,511 A * 6/1998 Henderson ..... 700/66
5,935,183 A * 8/1999 Sahm et al. ..... 701/50
5,951,613 A * 9/1999 Sahm et al. ..... 701/50
6,044,316 A 3/2000 Mullins
6,052,647 A * 4/2000 Parkinson et al. ..... 701/215

(Continued)

FOREIGN PATENT DOCUMENTS

JP 09042963 * 2/1997

OTHER PUBLICATIONS

Technical Notes: SiteVision Automatic Grade Control System, Trimble Navigation Limited, downloaded from http://tri.trimble.com/docushare/dsweb/Get/Documents-9160/SiteVision TN. pdf on Jan. 21, 2005.

*Primary Examiner*—Thomas A Beach
(74) *Attorney, Agent, or Firm*—Wolff & Samson PC

(57) ABSTRACT

A method and apparatus for using satellite positioning systems to more precisely locate the position of a portion of an attachment on an earthmoving machine is disclosed. More specifically, satellite positioning system antennas are mounted to an arm or other point relative to the arm of an illustrative excavator. A reference point relative to these antennas is used to determine the precise location of a portion of an attachment to the excavator, such as the prongs of a bucket. In one embodiment, an angle sensor or inclinometer is used to ascertain the position of the prongs when the bucket is scooped. In another embodiment, an angle sensor or inclinometer is used to measure the tilt of the body of the excavator, such as would occur when the excavator is resting on a sloped surface.

26 Claims, 7 Drawing Sheets

U.S. PATENT DOCUMENTS

| | | | | |
|---|---|---|---|---|
| 6,112,139 | A | 8/2000 | Schubert et al. | |
| 6,199,000 | B1 * | 3/2001 | Keller et al. | 701/50 |
| 6,253,160 | B1 * | 6/2001 | Hanseder | 702/95 |
| 6,282,477 | B1 * | 8/2001 | Gudat et al. | 701/50 |
| 6,324,455 | B1 * | 11/2001 | Jackson | 701/50 |
| 6,374,147 | B1 | 4/2002 | Rockwood | |
| 6,449,884 | B1 | 9/2002 | Watanabe et al. | |
| 6,532,409 | B1 | 3/2003 | Fujishima et al. | |
| 6,553,299 | B1 * | 4/2003 | Keller et al. | 701/50 |
| 6,614,361 | B1 | 9/2003 | Kinugawa | |
| 6,643,576 | B1 * | 11/2003 | O Connor et al. | 701/50 |
| 6,691,435 | B1 | 2/2004 | Schultz et al. | |
| 6,711,838 | B2 * | 3/2004 | Staub et al. | 37/348 |
| 6,782,644 | B2 | 8/2004 | Fujishima et al. | |
| 6,923,390 | B1 * | 8/2005 | Barker | 239/729 |
| 7,317,977 | B2 * | 1/2008 | Matrosov | 701/50 |
| 2003/0036817 | A1 | 2/2003 | Morley et al. | |
| 2003/0147727 | A1 * | 8/2003 | Fujishima et al. | 414/200 |
| 2005/0027420 | A1 * | 2/2005 | Fujishima et al. | 701/50 |
| 2005/0080559 | A1 * | 4/2005 | Ishibashi et al. | 701/213 |
| 2005/0197756 | A1 * | 9/2005 | Taylor et al. | 701/50 |
| 2005/0278099 | A1 * | 12/2005 | Benckert et al. | 701/50 |
| 2006/0031042 | A1 * | 2/2006 | Ogura et al. | 702/184 |
| 2007/0255494 | A1 * | 11/2007 | Politick et al. | 701/213 |

* cited by examiner

METHOD AND APPARATUS FOR SATELLITE POSITIONING OF EARTH-MOVING EQUIPMENT

BACKGROUND OF THE INVENTION

The present invention relates generally to positioning and, and more particularly to the dynamic positioning of excavators.

Various types of machines, referred to herein as earthmoving machines, have been developed to alter the topology or geography of terrain. FIG. 1 shows one such earthmoving machine, an excavator, which is well known in the art. As shown in FIG. 1, excavators such as excavator 100 typically have a main body 101 with a vehicle operator cab 102. Attached to the main body 101 is arm 103, commonly referred to as a "boom." Boom 103 is, in turn, attached to a second arm 104, commonly referred to as a "stick." Stick 104 may be adapted to hold different attachments. Here, stick 104 is attached, illustratively, to a bucket 105 for use in excavation/digging. Bucket 105 typically has prongs 106 attached to the leading edge of the bucket 105 that are used to break through ground and other materials to be excavated. Body 101 is attached to a base which is supported by, illustratively, tracks 107 that allow the excavator to move over a variety of surfaces. One skilled in the art will recognize that other bases have also been designed to be fixed in a single location and, therefore, have no tracks. Alternatively, some bases have been designed with wheels (instead of tracks) which may be desirable in different applications. Regardless the type of base, body 101 is typically attached to the base in a way such that body 101 is capable of rotating 360 degrees while the base remains stationary. Thus, the boom, stick and bucket are movable for digging or other purposes to all points around the base within a certain radius. One skilled in the art will recognize the bucket 105 may be moved with a high degree of flexibility within that given radius. For example, boom 103 may be raised or lowered by lengthening or shortening hydraulic pistons 108, respectively. Similarly, stick 104 may be rotated about pivot point 109 to raise or lower bucket 105 by shortening or lengthening hydraulic piston 110, respectively. Finally, bucket 105 may be rotated about pivot point 111 into a cupped or an open position by either lengthening or shortening hydraulic piston 112.

Excavators, such as excavator 101 in FIG. 1, are useful for many applications. For example, excavators may be used in the digging of trenches, holes and foundations; demolition; general grading and landscaping; heavy lifting (e.g., lifting and placing pipes); river dredging; etc. Initially, the operation of such excavators was performed by skilled operators in conjunction with a ground crew, for example a crew of workers equipped with surveying instruments to ensure, for example, the correct dimensions of an illustrative foundation in the ground. This mode of operation continues to be in widespread use today. However, this mode of operation is time consuming and labor intensive.

In order to decrease the time and cost associated with earthmoving operations, there have been various attempts at automating the operation of excavators and other earthmoving machines. For example, in one method disclosed in U.S. Pat. No. 6,782,644 to Fujishima et al., a satellite-based navigation system, such as the well-known Global Positioning System (GPS) or the Global Orbiting Navigation Satellite System (GLONASS), is used to control an excavator by remote control. Other similar systems have also been used to precisely monitor the movement of excavators during earthmoving operations.

FIG. 2 shows a prior art excavator using satellite positioning to increase excavation accuracy. Specifically, antennas 201 and 202 are mounted on body 101 of excavator 100. Using well known positioning techniques, the location of each antenna may be ascertained with a predetermined level of accuracy. The highest accuracy may typically be achieved with differential or real time kinematic (RTK) satellite positioning which uses a base station to help reduce the errors associated with received signals from positioning satellites. Such differential/RTK methods for reducing these errors are well known. Using such methods, the position of antennas 201 and 202 may be determined with a high degree of horizontal accuracy (illustratively plus or minus 5 millimeters) and vertical accuracy (illustratively plus or minus 12-18 millimeters).

Determining the precise locations of antennas 201 and 202 allows accurate determination of the orientation of the body 101 of the excavator 100. For example, if one antenna is positioned lower than the other it would indicate that the body is tilted. Additionally, since the position of each antenna on the body of the excavator is known, determining the position of antenna 201 relative to the position of antenna 202 will provide an accurate measurement of the heading of body 101 of the excavator. Thus, using two antennas allows both tilt and heading measurements of the body 101. However, simply knowing the tilt and heading of the body 101 is not sufficient for high-precision excavation. Instead, the precise orientation of the bucket 105 and, more particularly, the precise position and orientation of the leading (or cutting) edge of the bucket must be known.

Prior attempts have relied on various methods for determining the position and orientation of the leading edge of the bucket to facilitate precise excavation. For example, in one such method, angle sensors have been placed on the boom, stick and bucket linkage. Such angle sensors are also referred to herein interchangeably as inclinometers. Thus, referring once again to FIG. 2, sensor 203 is placed on body 101, sensor 204 is mounted to boom 103, sensor 205 is mounted on stick 104, and sensor 206 is placed on bucket 105. These sensors are calibrated for a given position of the cutting edge and or prongs of the bucket 105. Thus, any angular movement of the sensor (i.e., movement of the associated portion) can be measured. The dimensions of the boom, stick and bucket are known, and the length from the positioning system antennas can be measured. Accordingly, for any angular change detected by sensors 203-206 in FIG. 2, the location of the cuffing edge of bucket 105 can be geometrically calculated and excavation operations can be accurately performed in less time using fewer people than prior manual methods.

SUMMARY OF THE INVENTION

While earthmoving machines, such as the aforementioned excavators, using satellite positioning systems are advantageous in many applications, the present inventor has recognized that these systems are limited in certain regards. For example, while such systems are more accurate than prior, manual methods of excavation, they require several measurements by angle sensors in addition to the measurements by the satellite positioning system. Each of the measurements by these additional sensors adds error, thus reducing the overall positional accuracy of the leading edge of the bucket. Additionally, multiple angle sensors and associated electronics equipment are required to calculate the necessary geometric positional data. Such equipment adds substantially to the overall cost of the system. Finally, additional work is required to accurately mount and calibrate each of the sensors.

The present inventors have invented a method and apparatus for using satellite positioning systems to more simply locate the position of a portion of an attachment on an earthmoving machine. More specifically, satellite positioning system antennas are mounted to a stick of an illustrative excavator or backhoe. A reference point relative to these antennas is used to determine the precise location of a portion of an attachment to the excavator/backhoe, such as the prongs of a bucket. In one embodiment, an angle sensor or inclinometer is used to ascertain the position of the prongs when the bucket is scooped. In another embodiment, an angle sensor or inclinometer is used to measure the tilt of the body of the excavator/backhoe, such as would occur when the machine is resting on a sloped surface. In yet another embodiment, the tilt of the body of the machine is determined by taking a first position measurement when the boom/stick of the excavator are in a first position and then taking another measurement when the boom/stick of the excavator are in a second position.

More specifically, an earthmoving machine in accordance with one embodiment of the principles of the present invention comprises a first load-bearing arm, such as a boom; a second load-bearing arm, such as a stick, rotatably connected to said first load-bearing arm; and an attachment, such as a bucket, attached to said second load-bearing arm. At least a first satellite positioning system antenna is attached to a known location relative to the second load-bearing arm. The earthmoving machine further comprises means for determining the position of the at least a first satellite positioning system receive antenna and further comprises means for determining the position of a portion of said attachment, such as the prongs on a bucket, as a function of the position of the at least a first positioning system receive antenna.

These and other advantages of the invention will be apparent to those of ordinary skill in the art by reference to the following detailed description and the accompanying drawings.

DETAILED DESCRIPTION OF THE INVENTION

Figure 3:
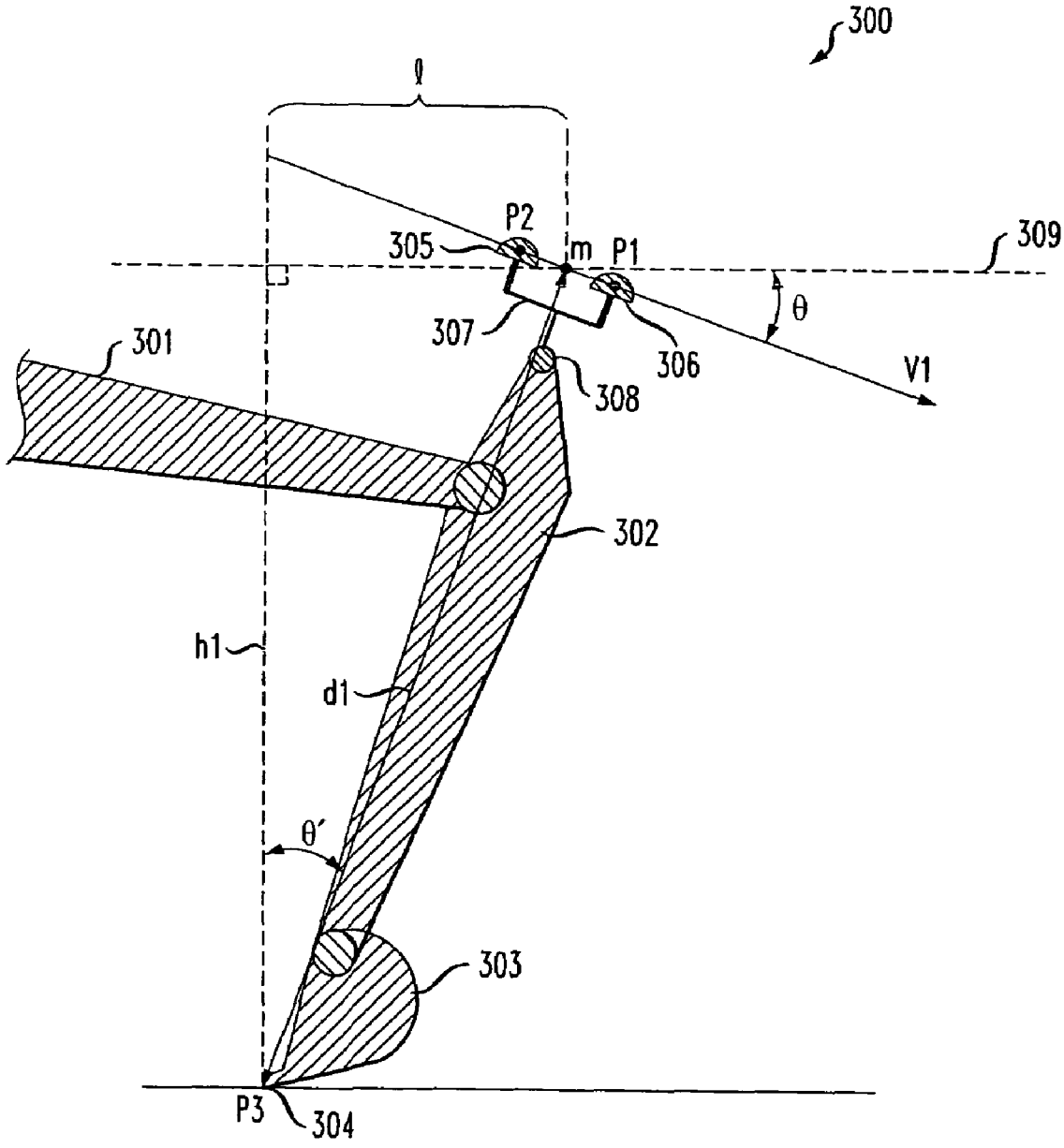
FIG. 3 shows one embodiment of an excavator adapted to utilize a satellite positioning system in accordance with the principles of the present invention.

FIG. 3 shows a boom, stick and bucket assembly of an illustrative excavator in accordance with the principles of the present invention. The boom and stick are also referred to herein as "load-bearing arms". Specifically, referring to FIG. 3, boom 301 is connected to stick 302 which is, in turn, attached to bucket 303, as discussed above. However, unlike the previously discussed excavators that utilized a satellite positioning system to assist in the control of the machine, the antennas 305 and 306 are mounted on support structure 307 which is attached to stick 302 at illustrative point 308. One skilled in the art will recognize that antennas 305 and 306 may be positioned in many different configurations. For example, the antennas may each be mounted separately on the stick. Additionally, while the antennas are shown mounted longitudinally along the stick, one skilled in the art will recognize that other mounting configurations are possible.

In the illustrative excavator of FIG. 3, in order to conduct excavation operations with a high degree of accuracy, it is necessary to know the position of bucket 303 with a high degree of accuracy and, more particularly, to know the position (e.g., the height/depth) of cutting teeth/prongs 304. As discussed above, prior methods required knowledge of the dimensions of several excavator portions as well as multiple angle sensors to determine the location of prongs 304. However, by mounting the antennas directly on the stick, as shown in the illustrative embodiment of FIG. 3, it is possible to precisely determine the position of the prongs 304 without multiple angle sensors and with only knowing the distance of the prongs from a reference point relative to antennas 305 and 306. For example, points P1 and P2 represent the determined positions of antennas 306 and 305, respectively, that are obtained via well known satellite positioning techniques using a satellite positioning receiver and other electronic components. Accordingly, a midpoint m between those two receivers (or any other point between the two receivers) may be known with the same precision as the positions of both points P1 and P2 corresponding to antennas 306 and 305 respectively. Distance d1 may be directly measured and entered into an illustrative graphic computer adapted for use in excavation operations. When antennas (represented by points P2 and P1) are determined to be in a horizontal plane, represented in cross section by line 310, the angles $\theta=\theta'=0$ degrees. In this case, h1=d1. For all other situations where the antennas 305 and 306 are not in the same horizontal plane, the angles $\theta=\theta'\neq 0$. These angles can be determined by determining the angular difference between vector V1, created by the difference in the heights of the antennas (points P2 and P1), and the horizontal plane 309. As discussed above, d1 is directly measured and remains constant. Therefore, one skilled in the art will recognize that simple geometry can be used to determine both the height h and the precise position of the prongs 304 relative to point m. Specifically, the lateral offset distance l from point m can be determined by the equation:

$$l=(d1)(\tan(\theta')) \qquad \text{(Equation 1)}$$

and the height h1 can be determined by the equation:

$$h1=\frac{d1}{\cos(\theta')} \qquad \text{(Equation 2)}$$

Thus, according to the foregoing, both the lateral offset and the height of the prongs 304 may be determined. Therefore, as one skilled in the art will recognize, if the heading/direction in which boom 301 is oriented were determined, a precise dimensional location of prongs 304 relative to point m could be determined.

Figure 4:
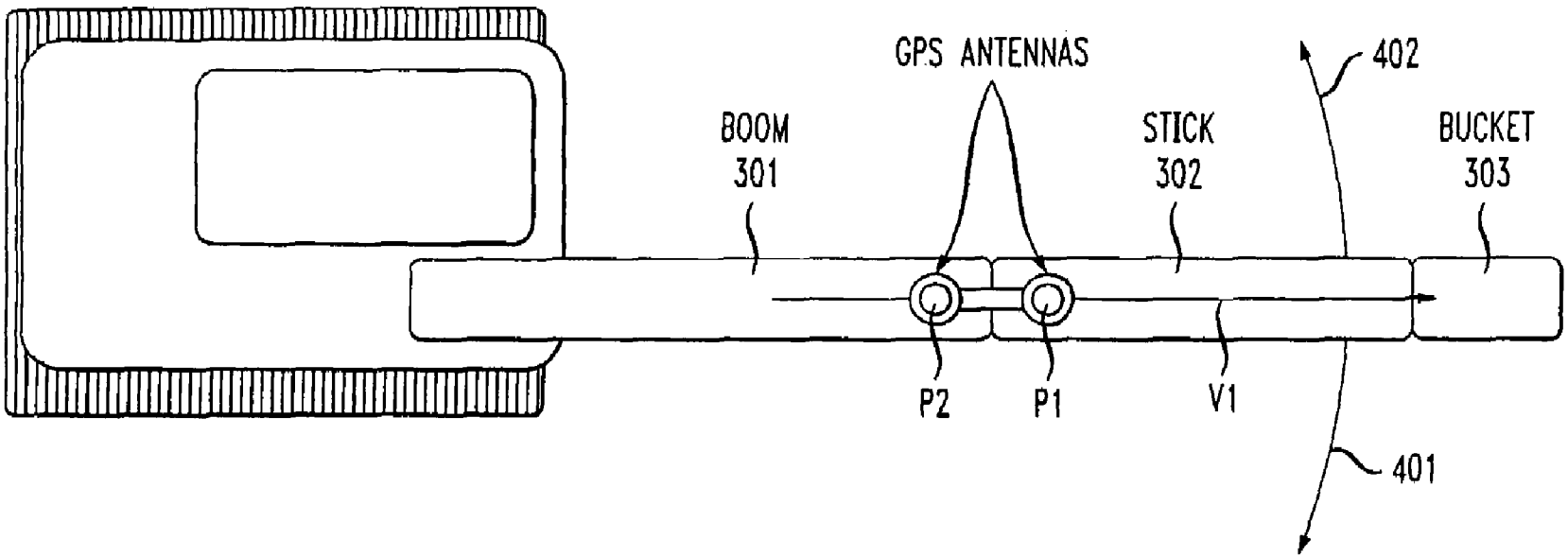
FIG. 4 shows a top view of the excavator of FIG. 3.

FIG. 4 illustrates how the heading of the boom 301 may be determined. Specifically, one skilled in the art will recognize that the geographic coordinate positions of points P1 and P2 may be accurately derived. Since the satellite positioning antennas 305 and 306 are mounted longitudinally on the stick 302, by comparing the positions of points P1 and P2, the heading of vector V1 and, hence, the heading in which boom 301 is pointed, may be derived. Each time the boom is moved, such as in direction 402 or 401, a new heading may be determined. Coupled with the above calculations of l and h1, an exact three-dimensional position of the prongs of the bucket 303 may be determined relative to point m in FIG. 3. Unlike prior attempts, this position is advantageously determined in accordance with the principles of the present invention with only two satellite positioning antennas and the length of only, the stick and bucket. Accordingly, the shortcomings of prior attempts in terms of lower accuracy, excess cost and large amount of time to install and calibrate a multitude of sensors are avoided.

Figure 5A:
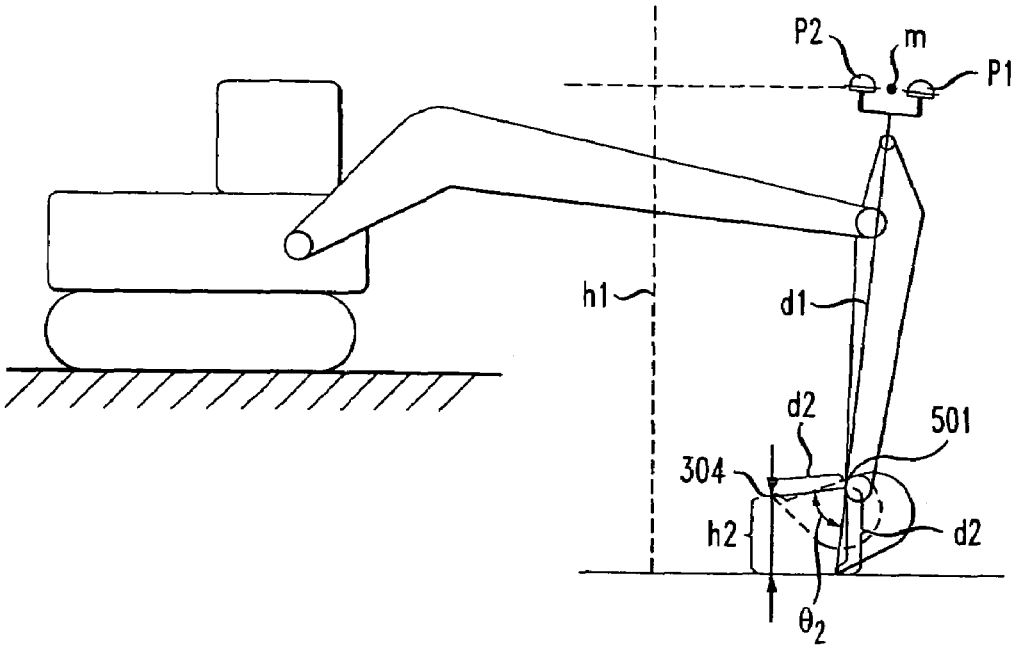
FIGS. 5A and 5B illustrate an excavator in accordance with the principles of the present invention whereby an inclinometer is used to determine the precise location of a portion of an attachment of the excavator.
Figure 5B:
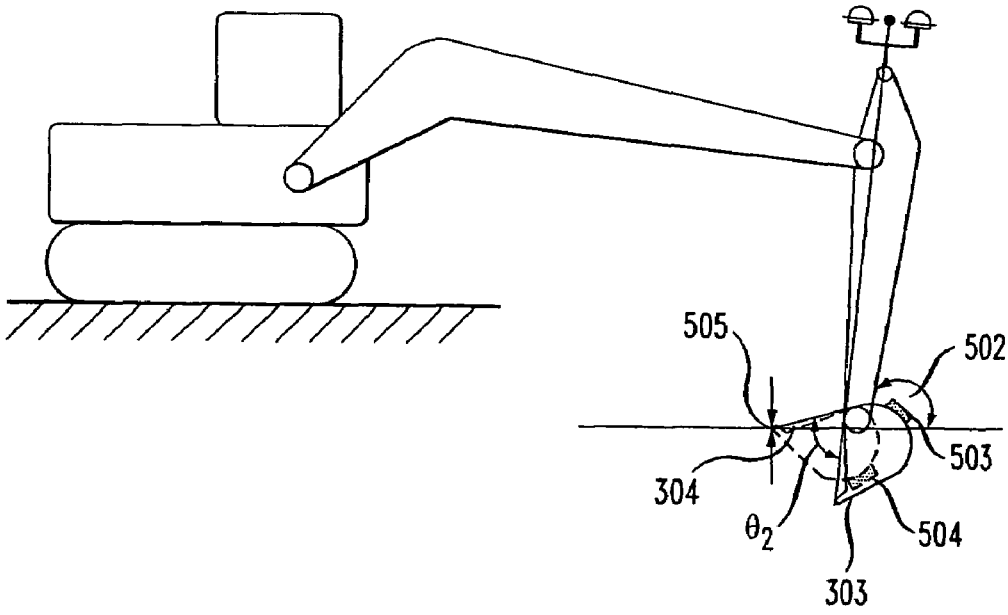

One skilled in the art will recognize that, while the precise distance d1 in FIG. 3 between point m and the prongs 304 of the bucket 303 may be directly measured, the bucket is frequently rotated from the position shown in FIG. 3. For example, the bucket is frequently "scooped" during excavation operations in order to hold dirt or other material securely while being lifted away from a site and carried to another location. As shown in FIG. 5A, the prongs 304 will be a distance below the horizontal plane 309 in FIG. 3 equal to h1-h2. Thus, the geometric calculations described above relying on the distance h1 will be inaccurate if used to calculate the positions of prongs 304. One method of determining where prongs 304 are positioned is to measure the distance d2 from the point 501 about which the bucket pivots, to the prongs 304 on the bucket. In this way, the distance d1 and the distance d2 will both be known and constant. As a result, if the angle $\theta_2$ were known, the precise three dimensional location of the prongs would also be known. As shown in FIG. 5B, this angle $\theta_2$ may be measured by placing a sensor 502, such as an angle sensor/inclinometer, on the bucket 303. When the bucket is scooped the angle sensor 502 will, for example, rotate to position 504. Angle $\theta_2$ can be determined from the measurements taken by sensor 502. Thus, the position 505 of prongs 304 can be accurately determined. While this requires additional cost in installing and calibrating angle sensor 502, the cost is still substantially lower than prior attempts and the error introduced by adding the one sensor is still less than in the case of multiple sensors as used in the prior attempts.

Figure 6A:
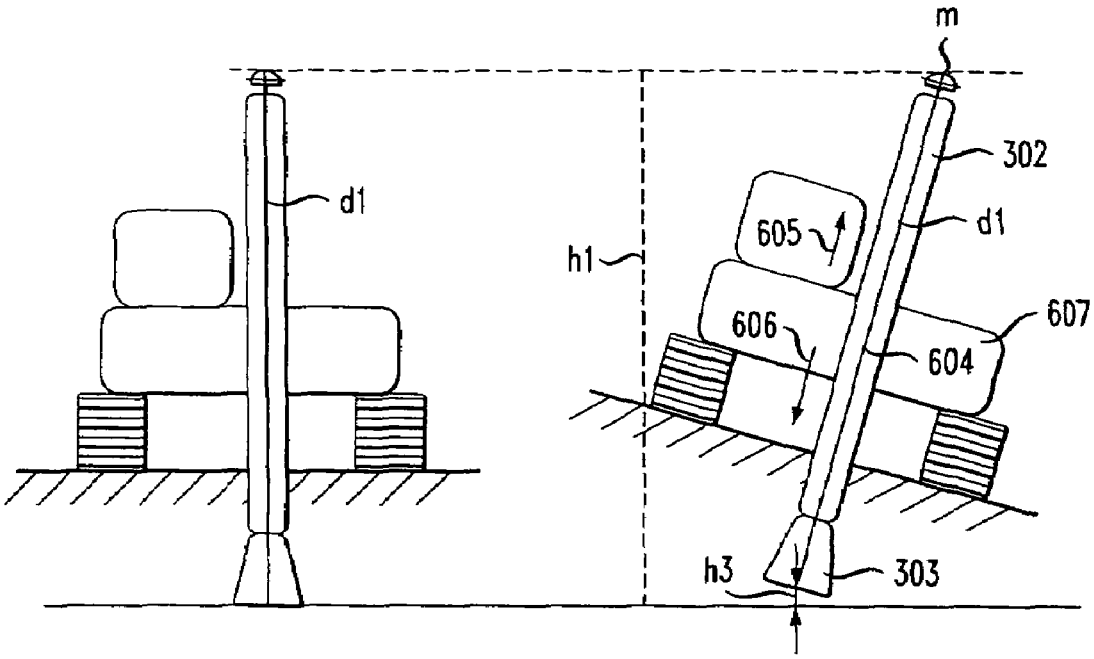
FIGS. 6A and 6B illustrate an excavator in accordance with the principles of the present invention whereby an inclinometer is used to determine the slope at which the excavator is oriented.
Figure 6B:
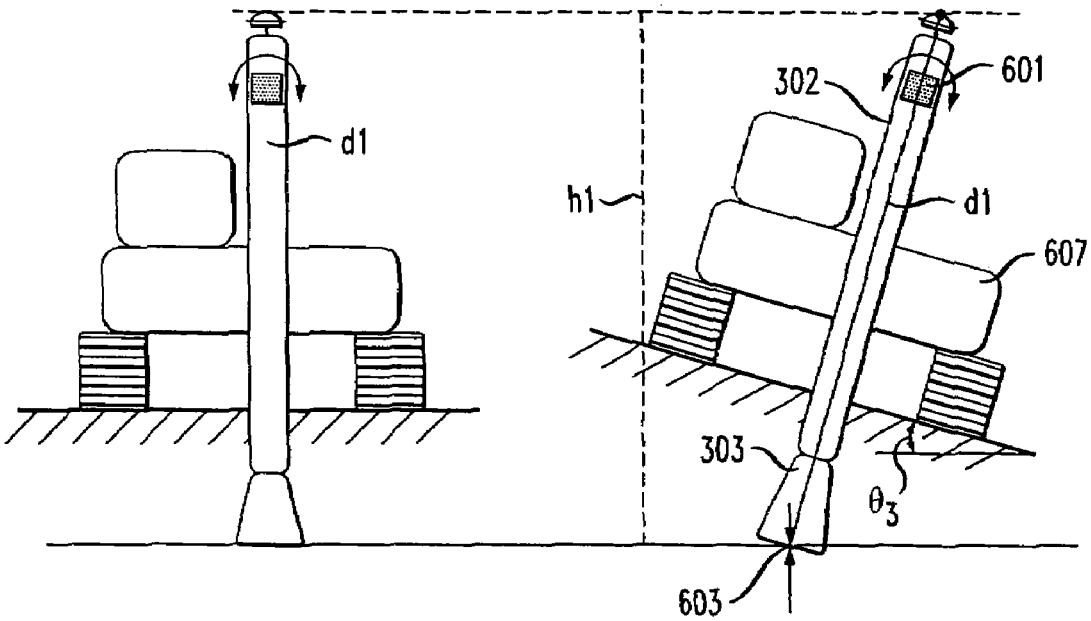

One skilled in the art will also recognize that errors to the calculations described above in association with FIG. 3 may be introduced if the base of the excavator is inclined laterally, such as would be the case if the underlying ground were sloped. FIG. 6A shows how such a situation would result in an error in the calculation of distance h1 of FIG. 3. Specifically, as discussed above, distance h1 would be calculated as being the vertical distance below point m at which the prongs 304 of FIG. 3 of the bucket 303 were located. However, when the ground 602 is sloped as shown in FIG. 6A, the prongs of bucket 303 would in actuality be a distance h1-h3 below point m. Referring to FIG. 6B, in order to determine the precise position of the prongs of bucket 303 in accordance with one illustrative embodiment, an illustrative angle sensor 601 may be used to determine the "tilt" of boom 302 and, hence, the angle θ3 at which the body of the excavator is resting. Thus, once again using geometric calculations familiar to one skilled in the art, the precise position of the prongs of the bucket 303 may be determined.

However, the present inventors have recognized that it would be desirable to be able to determine the position of the prongs without using the inclinometer/angle sensor 601. As previously described, antennas 305 and 306 in FIG. 3 having midpoint m that can be precisely located. By measuring the positions P1 and P2 of the antennas 306 and 305, respectively, it is possible to determine the heading in which the illustrative excavator is pointing. The present inventor has recognized that, if a plane containing point m could be identified, and that plane was related to the slope/tilt of the excavator, it would be possible to determine the orientation of that plane relative to the horizontal plane without the above-described inclinometer. It would follow that θ3 could be determined and the precise position of the prongs of bucket 303 could be determined without the use of an inclinometer The present inventor has recognized that, for a constant position of the body of the excavator, the midpoint m of antennas 306 and 305 can only move in a single plane as the sick and boom are moved. Specifically, referring to FIG. 6A, for a fixed position of body, stick midpoint m in that figure can only move in plane 604, shown in cross section in FIG. 6A as a line. Thus, the present inventor has further recognized that, by moving stick 302 and the attached boom (i.e., boom 301 in FIG. 3) the point m representing the midpoint of the positioning antennas will be on plane 604. As a result, by taking multiple measurements as the stick and midpoint m moves in plane 604 (e.g., as excavating operations are underway), it is possible to obtain three points in order to define that plane. Specifically, for example, a location of midpoint m may be determined when the boom is in the position represented by boom 302 in FIG. 6A. The stick of the excavator may then, for example, be moved in direction 605 and another measurement of midpoint m may be taken. Finally, the stick can then be rotated in direction 606 and a third location of midpoint m may be taken. Thus, by taking at least three measurements, the plane in which midpoint m lies can be determined. Since the boom/stick are mounted at a 90 degree angle to the body of the excavator, plane 604 by definition is at a 90 degree angle relative to the tilt angle of the excavator, represented by angle θ3 in FIG. 6B relative to the horizontal plane. Accordingly, once the plane 604 is known, simple geometry will give angle θ3. Once this angle θ3 is known, the position of the prongs of the bucket may be determined precisely. One skilled in the art will recognize that the procedure for determining such a plane would differ in one aspect if the earth moving machine were a backhoe as opposed to an excavator. Specifically, as discussed previously, the boom on a backhoe is capable of rotating about a point on the body of the backhoe. Therefore, instead of simply ensuring that the body of the backhoe remains in a single position, as is the case with an excavator, it is also necessary to ensure that the boom of the backhoe does not rotate to different positions relative to the body while measuring plane 604.

Figure 1:
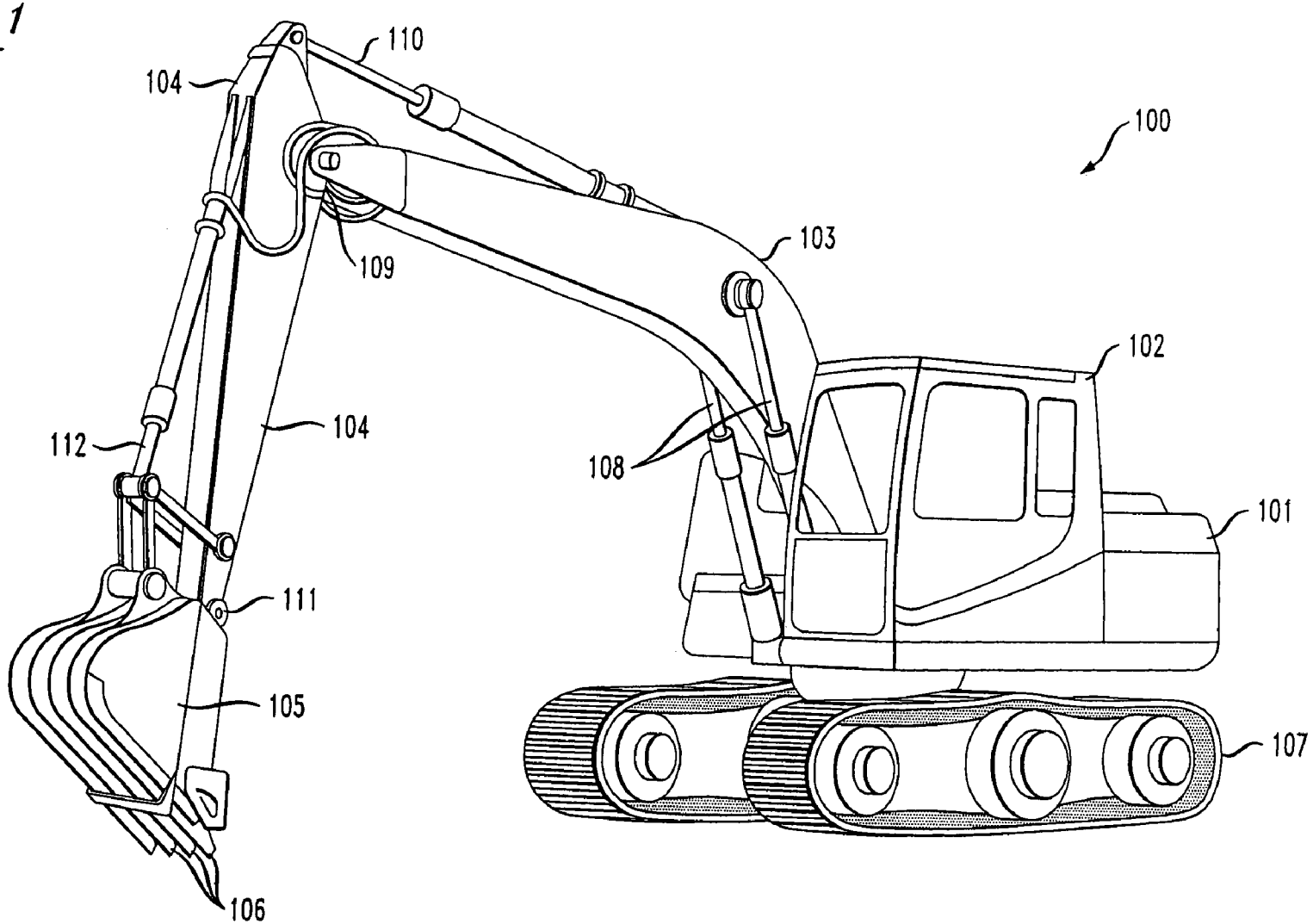
FIG. 1 PRIOR ART
FIG. 1 shows an illustrative prior art excavator.
Figure 2:
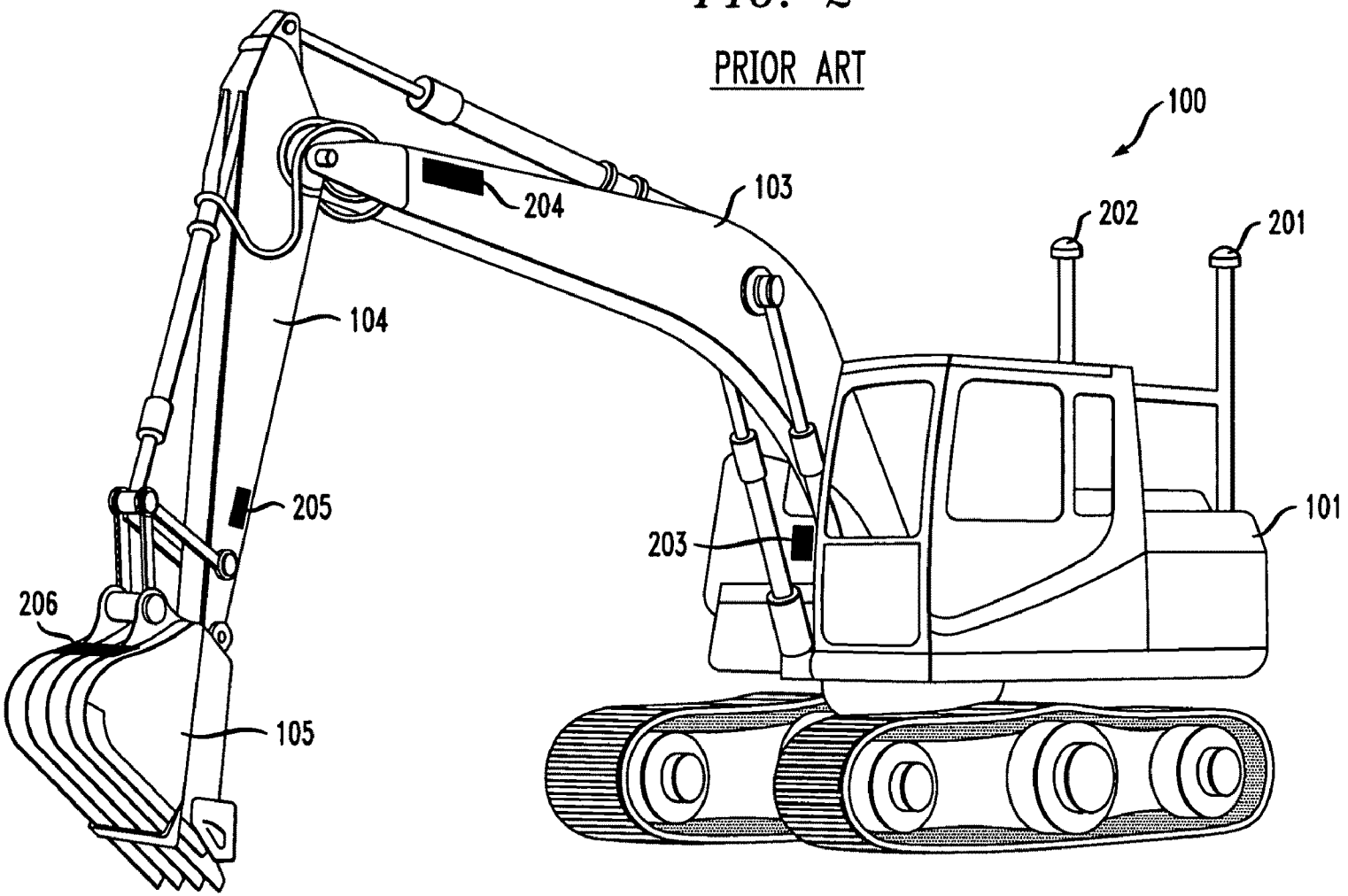
FIG. 2 PRIOR ART
FIG. 2 shows an illustrative prior art excavator adapted to use a satellite positioning system.
Figure 7:
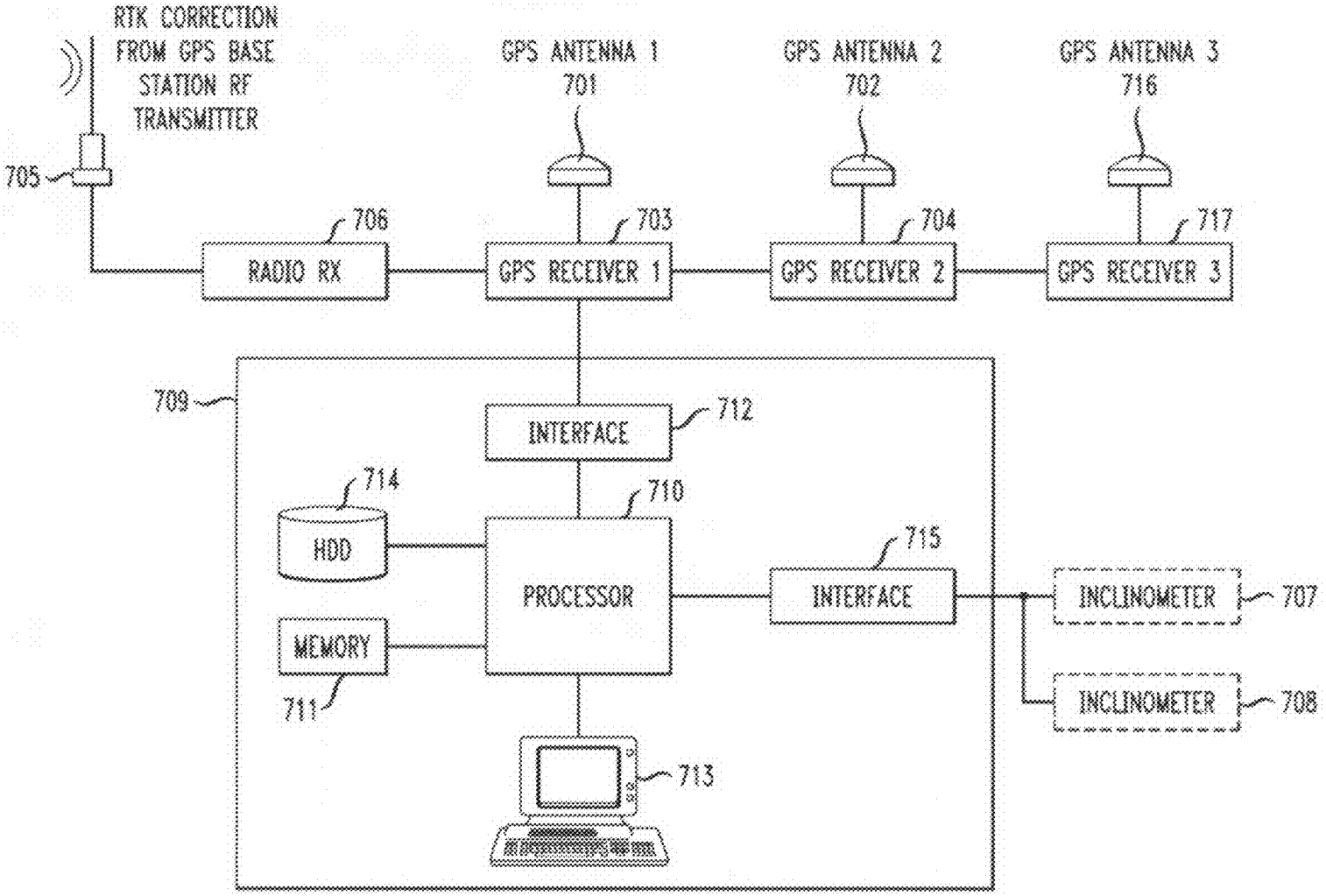
FIG. 7 shows an illustrative block diagram of a satellite positioning receiving system suitable for use with an excavator in accordance with the principles of the present invention.
Figure 7:
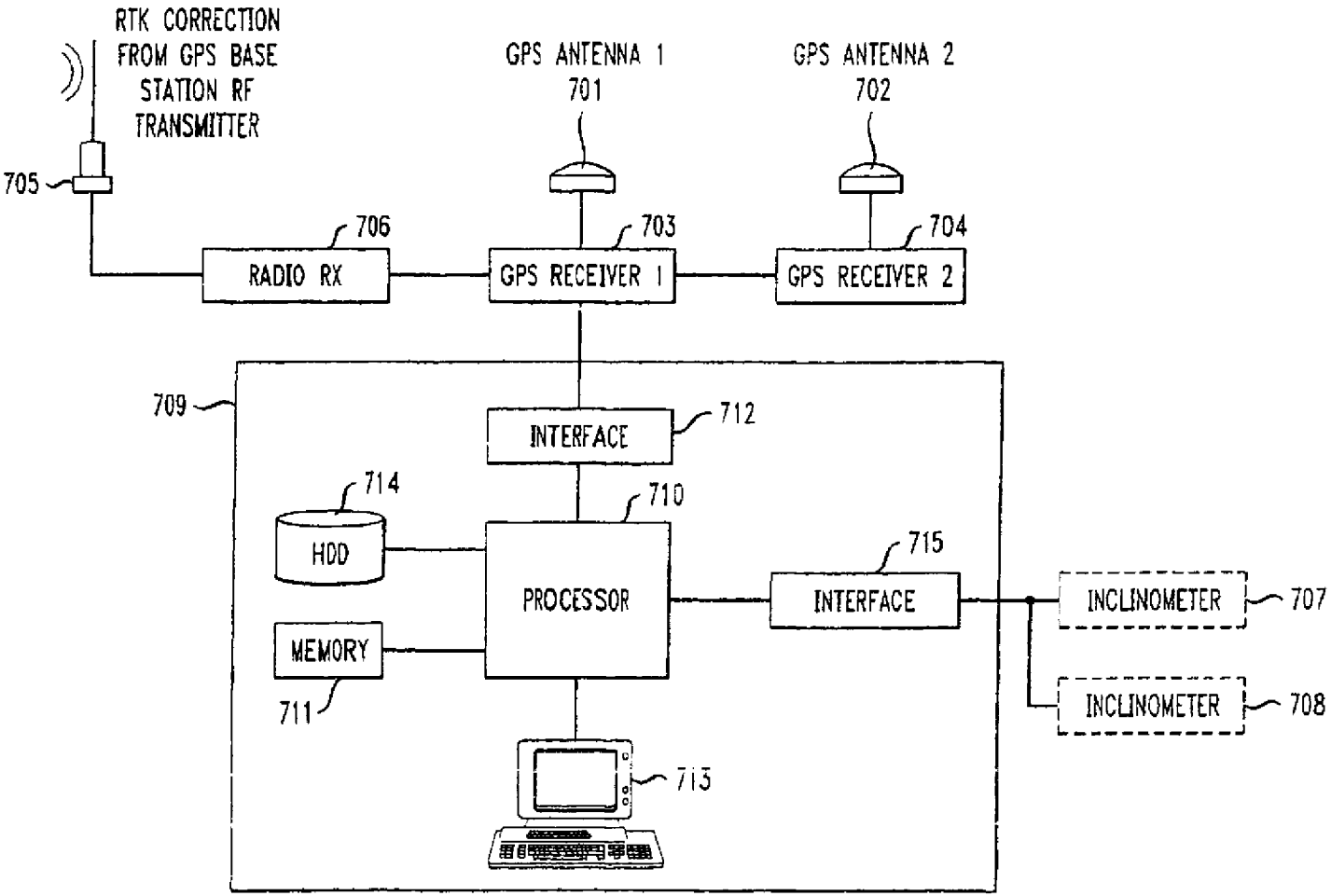

FIG. 7 shows how the various electronic portions of the excavation system disclosed herein may be used together. Specifically, as discussed above, a plurality of satellite positioning system antennas, such as GPS positioning antennas 701 and 702, are positioned on the stick of an excavator, such as stick 104 in FIG. 1. Each of these antennas is connected to a corresponding receiver 703 and 704 which determine the precise position of each antenna 701 and 702. The position of each antenna is more accurately obtained in the illustrative implementation of FIG. 7 by incorporating a correction signal obtained from a base station transmitter. The use of such a correction signal is typically referred to as "differential" positioning or as "real time kinematic" correction of positioning. The correction signal transmitted by the base station is received by a radio receiver 706 via antenna 705 and is used in the calculations of the positioning receivers 703 and 704 to obtain more accurate positions of antennas 701 and 702. As discussed previously, a reference point, such as point m in FIG. 3, is determined and a distance, such as distance d1 is calculated to the illustrative prongs of a bucket attached to the stick. Inclinometers/angle sensors 707 and 708 are used, as described illustratively above, to measure both the scoop of the bucket as well as the slope of the body of the excavator. These calculations are made and used in illustrative graphics computer 709 that is, for example, used by the excavator operator in controlling the excavation operations. Graphics computer 709 may be any suitable computer adapted to compute and/or display the position of the prongs and/or the bucket. Computer 709 may have, illustratively, a processor 710 (or multiple processors) which controls the overall operation of the computer 709. Such operation is defined by computer program instructions stored in a memory 711 and executed by processor 710. The memory 711 may be any type of computer readable medium, including without limitation electronic, magnetic, or optical media. Further, while one memory unit 711 is shown in FIG. 7, it is to be understood that memory unit 711 could comprise multiple memory units, with such memory units comprising any type of memory. Computer 709 also comprises interface 712 which provides for the transmission of antenna positional data associated with antennas 701 and 702 from GPS receivers 703 and 704 to computer 709. Computer 709 also illustratively comprises interface 715 adapted to receive slope and/or inclination data associated with the earthmoving machine/excavator or a component thereof. Although shown separately in FIG. 7, one skilled in the art will recognize that interface 712 may be the same interface as interface 715. Additionally, computer 709 also illustratively comprises one or more input/output devices, represented in FIG. 7 as I/O 713, for allowing interaction, for example, with an excavator operator or technician. Finally, computer 709 also illustratively comprises a storage medium, such as a computer hard disk drive 714 for storing, for example, data and computer programs adapted for use in accordance with the principles of the present invention as described hereinabove. One skilled in the art will recognize that computer 709 is merely illustrative in nature and that various hardware and software components may be adapted for equally advantageous use in a computer in accordance with the principles of the present invention.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. For example, while the above described embodiments involve an excavator, one skilled in the art will recognize that the principles described therein are equally applicable to other machines such as, for example, a backhoe. Typically backhoes differ from excavators in that the booms of backhoes are mounted in a way such that the boom can rotate about a pivot point relative to the body of the machines. Thus, while the body of the machine stays in one position, the boom rotates to move the bucket or other tool. The body and boom of excavators, on the other hand, are typically connected in a fixed manner such that the body and boom always have the same heading. In order to change the direction of the bucket, it is necessary to rotate the entire body of the excavator about a base. One skilled in the art will fully appreciate how the above described aspects of the embodiments of the present invention may be modified for use with such backhoes.

Other variations to the teachings described herein will also be obvious in light of the foregoing. For example, while the above-described embodiments refer to two satellite positioning antennas, one skilled in the art will recognize that three or more such antennas may be used. In such a case, it may be unnecessary to use an angle sensor/inclinometer on the stick of the excavator as the orientation of the plane created by the three or more antennas would be sufficient to determine the tilt of the excavator. Additionally, one skilled in the art will recognize that, while the aforementioned embodiments discuss an excavator having a bucket for excavation operations, other tools may be used for other purposes. For example, a claw or hook may be attached to the bucket or directly to the stick (e.g., interchangeably with the bucket) in order to pick up objects (e.g., pipes) and move them from one point to another. One skilled in the art will fully appreciate in light of the foregoing the necessary modifications of the above principles of locating a portion of these attachments, such as the end of the prongs of a claw or the precise location of the aforementioned hook. One skilled in the art will also appreciate that a claw, hook, bucket or other tool may not be an attachment to an excavator or other earthmoving machine but, alternatively, may be an integral component of the machine. As used herein, therefore, attachment and tool are used interchangeably to encompass all tools, whether attached to or integrated with the earthmoving machine. The principles disclosed herein are applicable generally to any use of satellite positioning by placing positioning antennas on one of the load bearing arms of earthmoving machines or other such similar equipment. Those skilled in the art could implement various other feature combinations without departing from the scope and spirit of the invention.

The invention claimed is:

1. Apparatus comprising:

a first arm;

a second arm rotatably connected to said first arm;

an attachment connected to said second arm;

a first satellite positioning system receive antenna mounted on said second arm;

a second satellite positioning system receive antenna mounted on said second arm;

means for determining the position of said first and second satellite positioning system receive antennas; and means for determining the position of a portion of said attachment as a function of said position of said first and second satellite positioning system receive antennas;

wherein said first arm comprises a boom of an excavator; said second arm comprises the stick of said excavator; and said attachment comprises a bucket of said excavator.

2. The apparatus of claim 1 wherein said first arm and said second arm are attached to said stick.

3. The apparatus of claim 1 wherein said portion of said attachment comprises one or more prongs of said bucket.

4. The apparatus of claim 1 wherein said second arm is connected to said first arm at a pivot point about which said second arm may pivot.

5. The apparatus of claim 1 wherein said satellite positioning system comprises the Global Positioning System (GPS).

6. The apparatus of claim 1 wherein said satellite positioning system comprises the Global Orbiting Navigation Satellite System (GLONASS).

7. The apparatus of claim 1 wherein said means for determining the position of said first and second satellite positioning system receive antennas comprises at least one satellite positioning system receiver.

8. The method of claim 7 further comprising a radio receiver adapted to receive a correction signal from a base station.

9. The apparatus of claim 1 wherein said means for determining the position of a portion of said attachment comprises a computer for geometrically determining the position of said portion from a point relative to said first and second positioning system receive antennas.

10. The apparatus of claim 1 wherein said means for determining the position of a portion of said attachment comprises:

means for determining the orientation of a plane in which a point at a known location relative to said first and second positioning system receive antennas is located.

11. The apparatus of claim 10 wherein said means for determining the orientation of a plane comprises:

means for determining a first position of said point, said first position of said point a function of a first position of said first arm;

means for determining a second position of said point, said second position of said point a function of a second position of said first arm; and means for determining a third position of said point, said third position of said point a function of a third position of said first arm.

12. The apparatus of claim 1 further comprising at least a first inclinometer for determining the inclination of at least a first portion of said apparatus.

13. Apparatus comprising:

a first arm;

a second arm rotatably connected to said first arm;

an attachment connected to said second arm;

a first satellite positioning system receive antenna attached to a known location relative to said second arm;

a second satellite positioning system receive antenna attached to a known location relative to said second arm;

a third satellite positioning system receive antenna attached to a known location relative to said second arm;

means for determining the position of said first, second, and third satellite positioning system receive antennas; and means for determining the position of a portion of said attachment as a function of said positions of said first, second, and third positioning system receive antennas.

14. A method for use in controlling an earthmoving machine, said earthmoving machine comprising a first arm, a second arm rotatably connected to said first arm, and an attachment connected to said second arm, said method comprising:

determining the position of at least two satellite positioning system receive antennas mounted on said second arm; and determining the position of a portion of said attachment as a function of said position of said at least two positioning system receive antennas;

wherein said first arm comprises a boom of an excavator, said second arm comprises a stick of said excavator, and said attachment comprises a bucket of said excavator.

15. The method of claim 14 wherein the step of determining the position of a portion of said attachment comprises:

determining the position of a known point relative to said positions of said at least two positioning system receive antennas;

determining an offset angle relative to a known plane, said offset angle associated with said second arm;

determining a longitudinal distance between a portion of said attachment and said position of said known point, said longitudinal distance a function of said offset angle; and determining a vertical distance between said portion of said attachment and said known point, said vertical distance a function of said offset angle.

16. The method of claim 15 wherein said longitudinal distance and said vertical distance are determined as a function of an angle of rotation of said portion.

17. The method of claim 14 further comprising:

determining the orientation of a plane in which a point at a known location relative to said at least a first positioning system receive antenna is located.

18. The method of claim 17 wherein said step of determining the orientation of a plane comprises:

determining a first position of said point, said first position of said point a function of a first position of said first arm;

determining a second position of said point, said second position of said point a function of a second position of said first arm; and determining a third position of said point, said third position of said point a function of a third position of said first arm.

19. An earthmoving machine comprising:

an arm, said arm comprising a tool;

a plurality of satellite positioning system receive antennas, each antenna in said plurality mounted on said arm;

at least a first positioning system receiver for determining the position of each antenna in said plurality of antennas; and at least a first circuit for geometrically determining the position of a portion of said tool as a function of the position of said plurality of antennas;

wherein said arm comprises a stick of an excavator.

20. The earthmoving machine of claim 19 wherein said tool comprises a bucket of said excavator.

21. The earthmoving machine of claim 19 wherein each antenna in said plurality of satellite positioning system receive antennas is attached to said stick.

22. The earthmoving machine of claim 19 wherein said portion of said tool comprises one or more prongs of said bucket.

23. The earthmoving machine of claim 19 wherein said arm is connected to a second arm of said earthmoving machine at a pivot point about which said load-bearing arm may pivot.

24. The earthmoving machine of claim 19 wherein said satellite positioning system comprises the Global Positioning System (GPS).

25. The earthmoving machine of claim 19 wherein said satellite positioning system comprises the Global Orbiting Navigation Satellite System (GLONASS).

26. The earthmoving machine of claim 19 further comprising a radio receiver adapted to receive a correction signal from a base station.

* * * * *

UNITED STATES PATENT AND TRADEMARK OFFICE

CERTIFICATE OF CORRECTION

PATENT NO. : 7,640,683 B2
APPLICATION NO. : 11/108013
DATED : January 5, 2010
INVENTOR(S) : Steven Daniel McCain It is certified that error appears in the above-identified patent and that said Letters Patent is hereby corrected as shown below:

Delete Drawing Sheet 7 of 7 and substitute therefore the attached Drawing Sheet 7 of 7 consisting of corrected FIG. 7.

Signed and Sealed this
Third Day of January, 2012

David J. Kappos

David J. Kappos
*Director of the United States Patent and Trademark Office*